US006536444B1

(12) United States Patent
Chung

(10) Patent No.: US 6,536,444 B1
(45) Date of Patent: Mar. 25, 2003

(54) METHOD OF PREVENTING NAILS FROM TURNING YELLOW WHEN EXPOSED TO ULTRAVIOLET LIGHT BY TEMPORARILY COVERING THE NAILS WITH A METAL FOIL

(76) Inventor: Anthony V. Chung, 11924 Blue Moon Ave., Oklahoma City, OK (US) 73162

( * ) Notice: Subject to any disclaimer, the term of this patent is extended or adjusted under 35 U.S.C. 154(b) by 0 days.

(21) Appl. No.: 09/792,836

(22) Filed: Feb. 23, 2001

(51) Int. Cl.[7] ..... A45D 29/00
(52) U.S. Cl. ..... 132/200; 132/73
(58) Field of Search ..... 132/200, 73

(56) References Cited

U.S. PATENT DOCUMENTS 4,600,030 A * 7/1986 Newman ..... 132/73
4,741,239 A * 5/1988 Crafton ..... 84/322
5,036,589 A * 8/1991 Heinrich ..... 132/73
5,765,731 A * 6/1998 Callian ..... 223/101
5,928,457 A * 7/1999 Engler ..... 132/73

FOREIGN PATENT DOCUMENTS

GB 637050 * 5/1950 ..... 132/73
WO 94/06322 * 3/1994 ..... 132/73

* cited by examiner

*Primary Examiner*—Todd E. Manahan
(74) *Attorney, Agent, or Firm*—Ted Masters

(57) ABSTRACT

A nail covering for protecting a finger or toenail from the harmful effects of ultraviolet light includes a thin sheet of metal (foil) shaped and dimensioned to cover the nail. In a preferred embodiment, the thin sheet of metal is shaped and dimensioned to cover the nail but not any surrounding flesh. In another preferred embodiment, the thin sheet of metal has an adhesive backing for attaching the thin sheet of metal to the nail.

1 Claim, 4 Drawing Sheets

Fig. 6
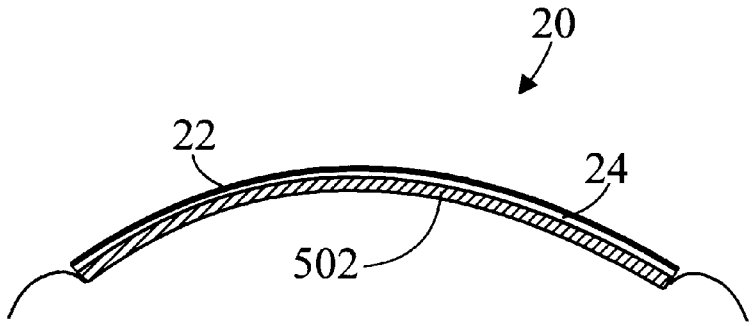
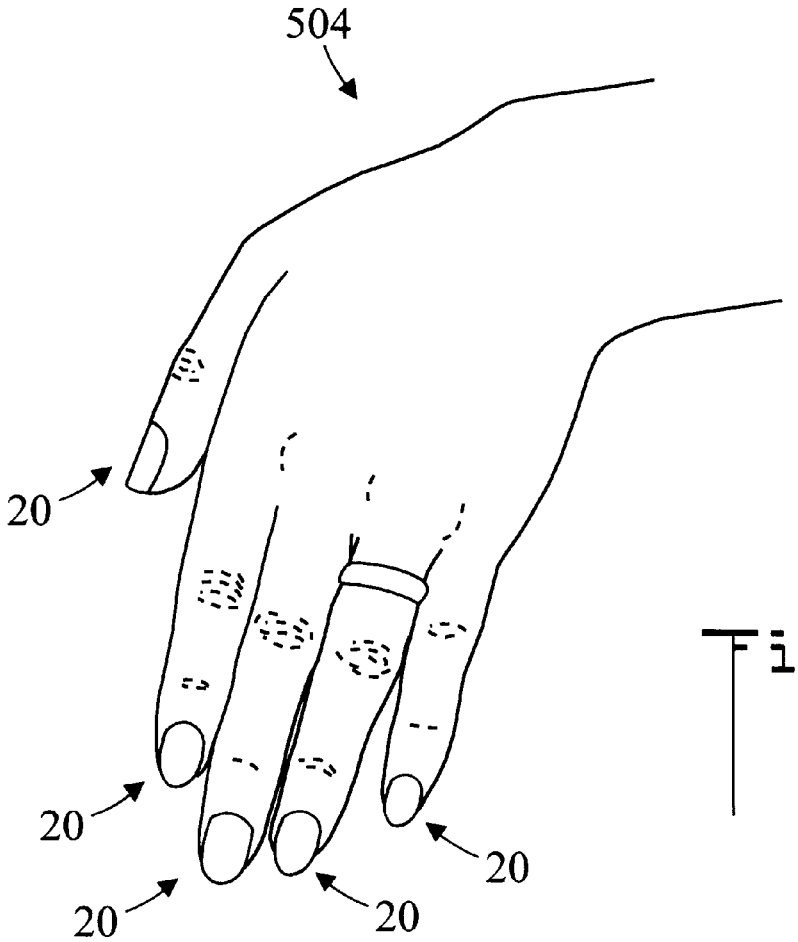
Fig. 7

METHOD OF PREVENTING NAILS FROM TURNING YELLOW WHEN EXPOSED TO ULTRAVIOLET LIGHT BY TEMPORARILY COVERING THE NAILS WITH A METAL FOIL

TECHNICAL FIELD

The present invention pertains to human finger and toenails, and more particularly to a nail covering for protecting the nails from the harmful effects of ultraviolet light.

BACKGROUND OF THE INVENTION

Devices for covering human finger and toenails are well known in the art. For example, U.S. Pat. No. 4,180,058 shows a method for treating pathological conditions of the nail, particularly onychomycosis. The method comprises the breaching the protective keratin of the nail to form an opening therein, placing a caustic-keratolytic agent in the opening to enlarge it, and treating the nail through the opening with topical therapeutic agents for the pathological condition being treated, for instance, an antifungal agent for onychomycosis. In addition, thick callouses and painful plantar warts can be removed with modifications of this method.

U.S. Pat. No. 4,860,774 illustrates a fingernail reinforcement extension material. The material is formed of a woven fiberglass fabric having a vertical and horizontal cross-thread count in the range of 25 to 55 threads per inch. Impregnated within said fabric is a preparation including cellulose, nylon fiber, resin, plasticizer and solvent in which, upon evaporation of the solvent, the preparation forms a hardened matrix within the weave of the fiberglass fabric. Also disclosed is a method for the use of the material in order to accomplish the reinforcement and extension of human fingernails. There is disclosed herein a fingernail covering for reinforcement of nails. The nail covering is formed of a woven fiberglass having a vertical and horizontal cross-thread count in the range of 25 to 55 threads per inch. Said fabric is preimpregnated with a suspension of resin polymer and monomer in water. The fabric is allowed to dry whereby the fabric is stabilized and the interstices between the threads are open. The fabric is coated with pressure sensitive adhesive. Also disclosed is a method for the preparation of the nail covering and the application thereof to the nails.

U.S. Pat. No. 4,962,731 defines a pliable sheath for animal toenails, providing protection for humans, furniture, clothes, and other animals. A sheath of this nature reduces self inflected trauma to the animal and provides an alternative to declawing. Protection is provided, while still leaving the animal with its natural defenses. The sheath, being adhered to the animal toenail, loosens and drops off, when the toenail grows and changes shape. Leaving the animal's own natural defenses in tact.

U.S. Pat. No. 5,261,872 discloses an appliance and method for correcting ingrown toenails. A thin, flat resilient strip is conformed to the shape of the toenail and adhesively attached to the toenail with a suitable adhesive. The strip extends to within one-eighth inch of either opposite side of the toenail, and when so applied, tends to bend resiliently bend back to its original flat shape. The corresponding torque effect created on the toenail is sufficient to cause the affected ingrown toenail to grow out into a naturally correct position. The strip may be of a heat-sensitive material which is more pliable when heat is applied, and which resumes a greater degree of rigidity when the heat is dissipated. Bevelling of the edges around the outer perimeter of the strip smooths the transition of the strip into the surface of the toenail for aesthetic purposes.

U.S. Pat. No. 6,042,679 comprises a method and apparatus for treating damaged fingernails which includes the use of a sheet of transparent vinyl film coated on one side with an adhesive suitable to adhere to a fingernail, wherein a multiplicity of generally oval shaped forms and into a backing material to which the adhesive adheres releasable in such manner that an individual oval vinyl repair item may be peeled from the backing strip and placed upon a damaged fingernail and wherein the same material may be used in reverse in such manner that the adhesive material will be exposed before the item is removed from the backing strip and the fingernail may be pressed against the adhesive so as to facilitate the placing and removal of the protective vinyl on the fingernail.

U.S. Pat. No. 6,060,073 consists of a novel composition and method for forming artificial fingernails in situ and for prefabricated nails for people with weak, damaged nails. A vinyl fingernail extension is adhered to the top surface of the free end of a natural fingernail. Then for the in situ nail a coating of cyanoacrylate adhesive is applied to the vinyl extension and the natural nail. For the prefabricated nail, a fill in preliminary coating on the natural nail is first employed. Afterwards layers of a pink mixture in powder form of between approximately 8 and 12 parts by volume acrylic ester polymer or copolymer and 1 part sodium bicarbonate is applied to the adhesive coating while still wet to create an instant hardening. The coatings are repeated several times. The resulting nail looks naturally pink, blends into its finger, skin and nail environment, is hardy, corrects broken nails and is strong enough to protect against further damage to nails. Main benefit is that individuals whose nails are weak or broken and could not otherwise grow long nails because of this can do so and since the vinyl absorbs the adhesive and acrylic mixture and hardens, the artificial nail of the present invention need only be reinforced approximately every four weeks, a treatment that does not involve reapplying any vinyl extension. The vinyl extension just grows off and never needs to be replaced. Other compounds including sodium sulfate, sodium carbonate or sodium borate are substitutes for sodium bicarbonate but the result will not be as good.

One problem that people experience with their nails is that of "yellowing". Finger and toenails turn yellow after exposure to the sun or tanning solon lights. It is the ultraviolet light rays which cause the nails to yellow.

SUMMARY OF THE INVENTION

The present invention is directed to a nail covering which protects finger and toenails from the ultraviolet light of the sun or a tanning salon. A person applies the nail covering before exposure to ultraviolet light, and removes the nail covering when the exposure is concluded. A preferred name for the present invention is "Yellow-Proof".

In accordance with a preferred embodiment of the invention, a nail covering includes a foil shaped and dimensioned to cover a finger or toenail. The metal foil blocks the ultraviolet light, thereby prevents the nails from yellowing.

In accordance with an important aspect of the invention the foil is shaped and dimensioned to cover the nail but not any surrounding flesh.

In accordance with an important feature of the invention the foil has an adhesive backing for attaching the foil to the nail.

In accordance with another important aspect of the invention, a plurality of nail coverings include individual nail coverings of different sizes to cover different size nails.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 6 is a cross sectional view along the line 6—6 of FIG. 5 showing the nail covering with adhesive backing attached to a human fingernail;

FIG. 7 is a top plan view of a human hand showing the nail covering of the present invention installed on all of the fingers and thumb;

DETAILED DESCRIPTION OF THE INVENTION

Figure 1:
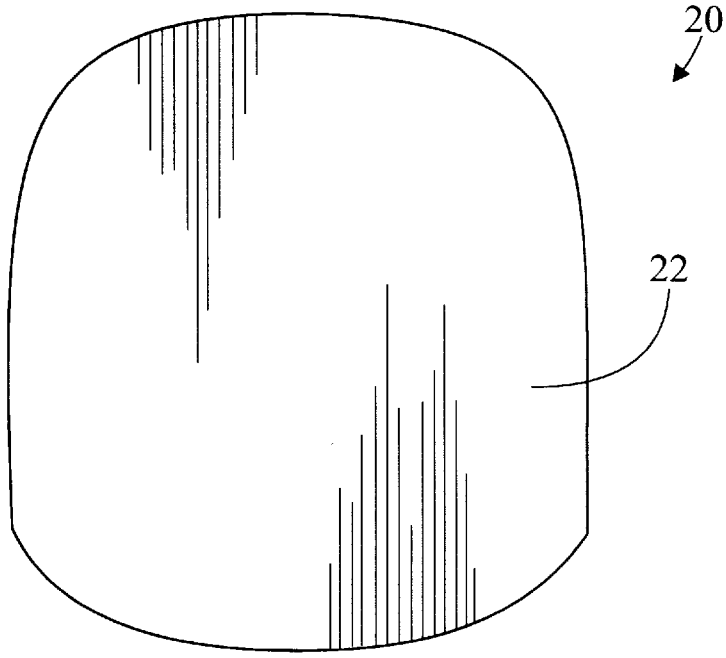
FIG. 1 is a top plan view of a nail covering in accordance with the present invention.
Figure 2:
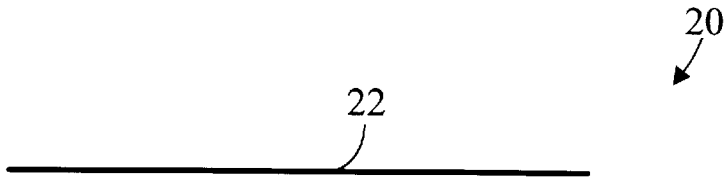
FIG. 2 is a side elevation view of the nail covering.

Referring initially to FIGS. 1 and 2, there are illustrated top plan and side elevation views respectively of a protective nail covering in accordance with the present invention, generally designated as 20. Nail covering 20 includes a thin sheet of metal 22 (also known as a foil) which is shaped and dimensioned to cover a nail (502) such as a fingernail, thumbnail, or toenail (refer to FIG. 4). Thin sheet of metal 22 can be fashioned from a variety of metals or metal combinations including any of aluminum, gold, silver, zinc, and copper. In the shown preferred embodiment, thin sheet of metal 22 is shaped and dimensioned to substantially cover the nail 502 but not any surrounding flesh (refer also to FIG. 5).

Figure 3:
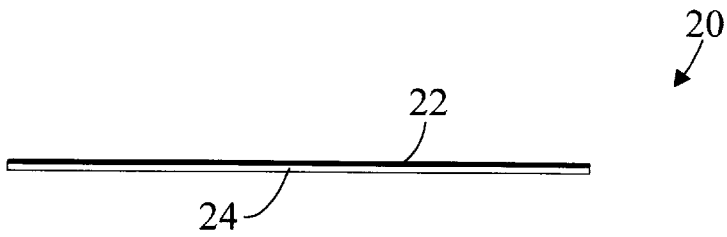
FIG. 3 is a side elevation view of the nail covering including an adhesive backing.

FIG. 3 is a side elevation view of nail covering 20 including an adhesive backing 24. Thin sheet of metal 22 has adhesive backing 24 for attaching the thin sheet of metal 22 to the nail 502. In a preferred embodiment, a plurality of nail coverings 20 with adhesive backing 24 are provided on a sheet so that individual nail coverings 20 may be conveniently peeled off for use.

Figure 4:
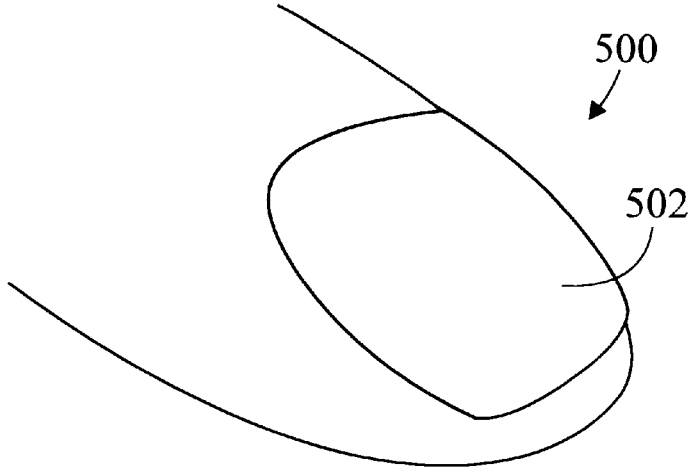
FIG. 4 is a reduced perspective view of a human finger.

FIG. 4 is a reduced perspective view of a human finger 500 and fingernail 502.

Figure 5:
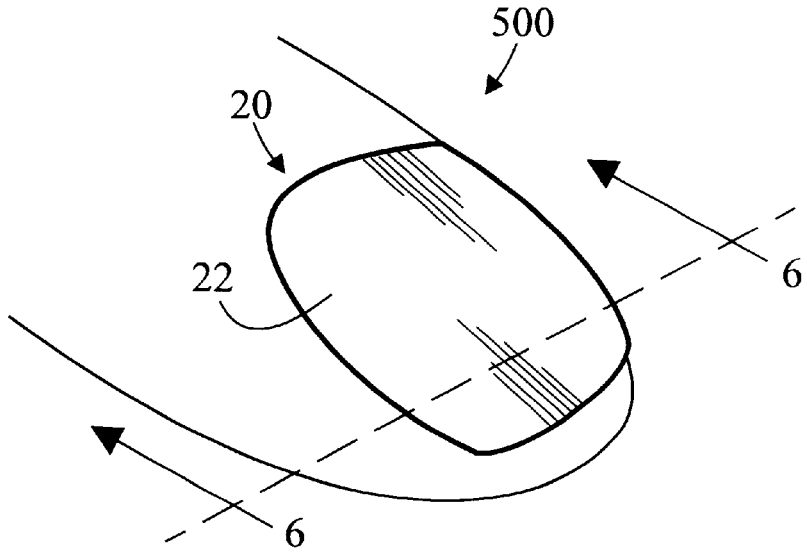
FIG. 5 is a reduced perspective view of the nail covering installed on the human finger.

FIG. 5 is a reduced perspective view of nail covering 20 installed on fingernail 502 of human finger 500. In a preferred embodiment, a plurality of nail coverings 20 includes individual nail coverings 20 of different sizes. For example, the nail covering 20 for the thumb would be larger than the nail covering 20 for the little finger.

FIG. 6 is a cross sectional view along the line 6—6 of FIG. 5 showing nail covering including thin metal sheet 22 with adhesive backing 24 attached to a human fingernail 502.

FIG. 7 is a top plan view of a human hand 504 showing nail covering 20 of the present invention installed on all of the fingers and thumb.

Figure 8:
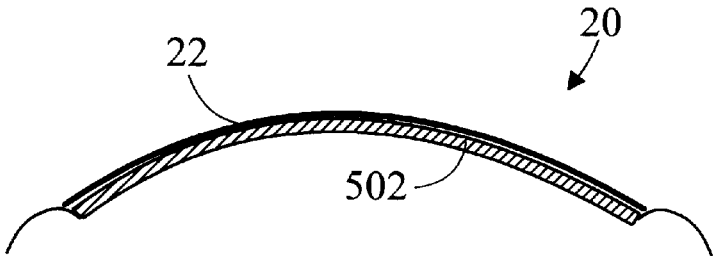
FIG. 8 is a cross sectional view along the line 6—6 of FIG. 5 showing a nail covering without adhesive backing installed on a human fingernail; and, FIG. 9 is a top plan view of a substantially rectangular nail covering embodiment.

FIG. 8 is a cross sectional view along the line 6—6 of FIG. 5 showing nail covering 20 without adhesive backing 24 installed on a human fingernail 502. In this embodiment thin metal sheet 22 is simply placed over nail 502.

Figure 9:
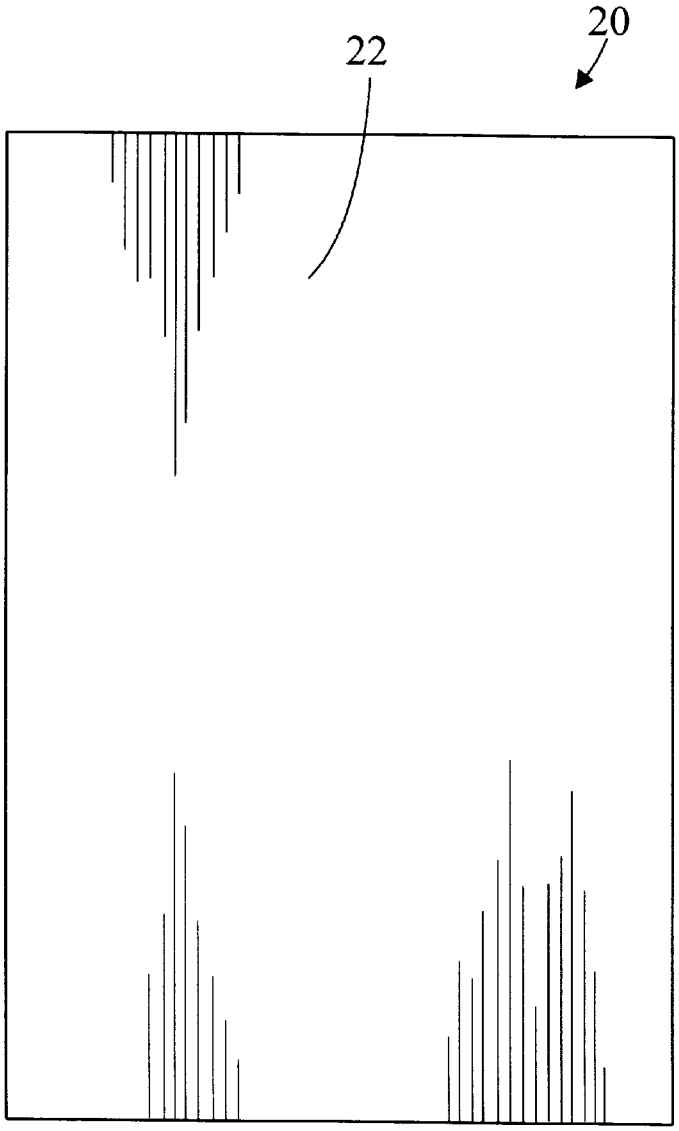

FIG. 9 is a top plan view of a substantially rectangular embodiment of nail covering 20. This nail covering 20 is not designed to cover only the nail 502, but would also cover part of the flesh of the finger or toe.

A method for protecting a finger or toenail from the harmful effects of ultraviolet light includes:

providing a foil; and, covering the nail with the foil.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for preventing a nail from turning yellow when exposed to ultraviolet light, comprising:

(1) providing a metal foil shaped and dimensioned to cover said nail;

(2) providing a source of ultraviolet light such as the sun or a tanning salon;

(3) only for the specific purpose of preventing said nail from turning yellow, applying said metal foil to said nail before exposure to said ultraviolet light;

(4) exposing said nail with said applied metal foil to said ultraviolet light;

(5) leaving said metal foil in place for the period said nail is exposed to said ultraviolet light;

(6) ceasing to expose said metal foil-covered nail to said ultraviolet light;

(7) removing said metal foil from said nail when exposure to said ultraviolet light is concluded; and, (8) observing that said metal foil prevented said nail from turning yellow.

* * * * *